US006919302B2

(12) United States Patent
Legros et al.

(10) Patent No.: US 6,919,302 B2
(45) Date of Patent: Jul. 19, 2005

(54) USE OF AN OIL COMPOSITION FOR TEMPORARY TREATMENT OF METAL SURFACES

(75) Inventors: Philippe Legros, Nogent sur Oise (FR); Jean-Luc Olive, Ensues la Redonne (FR); Agnès Marchand, Nimes (FR)

(73) Assignee: Usinor, Puteaux (FR)

( * ) Notice: Subject to any disclaimer, the term of this patent is extended or adjusted under 35 U.S.C. 154(b) by 407 days.

(21) Appl. No.: 10/276,402

(22) PCT Filed: May 15, 2001

(86) PCT No.: PCT/FR01/01476

§ 371 (c)(1),
(2), (4) Date: Nov. 15, 2002

(87) PCT Pub. No.: WO01/88068

PCT Pub. Date: Nov. 22, 2001

(65) Prior Publication Data

US 2004/0029749 A1 Feb. 12, 2004

(30) Foreign Application Priority Data

May 19, 2000 (FR) ..... 00 06465

(51) Int. Cl.[7] ..... C10M 101/04; C10M 105/32; C10M 111/02

(52) U.S. Cl. ..... 508/487; 508/486; 508/491; 508/555

(58) Field of Search ..... 508/486, 491, 508/487

(56) References Cited

U.S. PATENT DOCUMENTS

| | | | | |
|---|---|---|---|---|
| 1,862,765 A | | 4/1932 | Wilson | |
| 2,611,711 A | | 9/1952 | Costello | |
| 2,938,262 A | | 5/1960 | Barker | |
| 4,824,586 A | * | 4/1989 | Johnson et al. | 508/487 |
| 5,338,471 A | | 8/1994 | Lal | |
| 5,888,947 A | * | 3/1999 | Lambert et al. | 508/491 |
| 5,916,854 A | * | 6/1999 | Inaya et al. | 508/452 |
| 6,383,992 B1 | * | 5/2002 | Garmier et al. | 508/491 |
| 6,534,454 B1 | * | 3/2003 | Garmier et al. | 508/491 |
| 6,620,772 B2 | * | 9/2003 | Garmier | 508/491 |
| 6,624,124 B2 | * | 9/2003 | Garmier | 508/491 |

FOREIGN PATENT DOCUMENTS

| | | |
|---|---|---|
| EP | 0 200 001 | 11/1986 |
| EP | 0 744 455 | 11/1996 |
| EP | 0 843 000 | 5/1998 |

* cited by examiner

*Primary Examiner*—Ellen M McAvoy
(74) *Attorney, Agent, or Firm*—Sughrue Mion, PLLC

(57) ABSTRACT

The invention concerns the use of an oil composition for temporarily protecting and lubricating metal surfaces, characterised in that said composition contains: at least 30% of at least a saturated or unsaturated $C_{\leqq 18}$ fatty acid triglyceride (Compound A); 5 to 30% of at least a $C_{\leqq 18}$ fatty acid triglyceride with oleic acid content of at least 60 wt. % (Compound B); 5 to 30% of at least an ester derived from condensation of a $C_1$–$C_{12}$, preferably, $C_1$–$C_2$ aliphatic alcohol, with a $C_{\leqq 18}$ fatty acid (Compound C); and optionally 5 to 20% of at least an amide derived from condensation of a C¿≦18 ?fatty acid, and a $C_2$–$C_6$ mono- di- or tri-alkanolamine (Compound D). The invention also concerns a corresponding oil composition.

24 Claims, No Drawings

USE OF AN OIL COMPOSITION FOR TEMPORARY TREATMENT OF METAL SURFACES

The invention is aimed at the use of an oil composition for the temporary treatment of metal surfaces both for lubrication and for corrosion resistance. The subject of the invention is also a corresponding composition.

The treatment of metal surfaces for the purposes of giving them better tribological properties and better corrosion resistance is a constant preoccupation of those in the steel industry. To meet this object, many corresponding treatment formulations have already been developed.

Usually, just after the pickling step, the metal surfaces are provided with temporary corrosion protection by applying a 1 to 1.5 g/m$^2$ layer of a composition based on mineral oil and additives. As these mineral-oil-based compositions possess poor lubricating properties, it is necessary to apply a lubricating oily second layer to the metal surface before forming it by drawing under optimum conditions.

Applying two successive oil layers to the metal surface constitutes a loss of productivity in the step of treating the surface.

Furthermore, mineral oils because of their toxicity and their low biodegradability no longer meet the new criteria imposed by environmental regulations. This is why those in industry are turning toward natural, either vegetable or animal, oil compositions, so as to meet the toxicity and biodegradability criteria currently in force. However, hitherto, the oil compositions proposed have the drawback of not being fluid at room temperature, requiring those in industry to heat the oil composition before application to the metal surface or else to use dissolved oils.

The object of the present invention is to provide an oil composition which allows all of the aforementioned objectives to be met, consisting of whole and biodegradable oils fluid at room temperature, these being intended for the temporary treatment of metal surfaces both for lubrication and corrosion protection.

More specifically, the first subject of the present invention is the use of an oil composition for temporarily protecting and lubricating metal surfaces, characterized in that said composition contains:

- at least 30% of at least one saturated or unsaturated $C_{\leqq 18}$ fatty acid triglyceride (compound A);
- from 5 to 30% of at least one $C_{\leqq 18}$ fatty acid triglyceride with an oleic acid content of at least 60% by weight (compound B);
- from 5 to 30% of at least one ester derived from the condensation of a $C_1$–$C_{12}$, preferably $C_1$–$C_2$, aliphatic alcohol with a $C_{\leqq 18}$ fatty acid (compound C); and
- optionally, from 5 to 20% of at least one amide derived from the condensation of a $C_{\leqq 18}$ fatty acid and a $C_2$–$C_6$ monoalkanolamine, dialkanolamine or trialkanolamine (compound D).

The inventors have demonstrated that a composition according to the invention, that is to say one combining components A, B, C and, where appropriate D, proves to be particularly advantageous when used as a pretreatment for metal surfaces before rolling or before drawing, for the following reasons:

- the composition is biodegradable;
- the composition may be used as such, without it being necessary to heat or dissolve it;
- this composition is effective both for low-pressure and high-pressure lubrication and for corrosion protection;
- the treated metal surfaces are easily cleanable;
- the composition is stable and its cleanability does not decrease over time;

- the composition is compatible with the conventional rolling or drawing oils; and
- the composition is easily applicable as a thin layer by an electrostatic oil sprayer.

Compounds A and B derive from fatty acid triglycerides having a $C_{\leqq 18}$ aliphatic hydrocarbon group and are either natural vegetable oils or synthetic oils obtained by the reaction of one mole of glycerol with three moles of fatty acid or a mixture of fatty acids.

More preferably, the fatty acid triglycerides used come from natural vegetable oils so as to obtain a biodegradable composition.

As illustrations of fatty acids characterizing the triglycerides that can be used as compound A, mention may especially be made of:

- saturated aliphatic acids such as lauric ($C_{12}$) myristic ($C_{14}$), palmitic ($C_{16}$) and stearic ($C_{18}$) acid;
- unsaturated aliphatic acids such as oleic ($C_{18}$— 1 unsaturated group), linoleic ($C_{18}$—2 unsaturated groups) and linolenic ($C_{18}$—3 unsaturated groups) acids; and
- hydroxy acids such as ricinoleic ($C_{18}$—1 unsaturated group) acid.

Compound B itself is preferably a fatty acid triglyceride having an oleic acid content of at least 60%.

Oleic acid may be naturally present in vegetable oils in substantial proportions. In this regard, mention may be made of olive oil which naturally contains 65 to 85% oleic acid. However, vegetable oils, such as soybean oil, rapeseed oil, safflower oil, palm oil or sunflower oil, have much lower oleic acid contents; these contents are around 25 to 60%.

To enrich the abovementioned vegetable oils with oleic acid, the plants from which these oils are extracted undergo genetic modifications by hybridization using conventional methods. The oleic acid contents in these genetically modified oils are substantially increased; they are around 60 to 90%, preferably 65 to 85%, of the total fatty acid content.

These genetically modified vegetable oils, such as so-called oleic sunflower oils, are preferably chosen as compound B.

As regards compound C, this is preferably a fatty acid monoester or polyester derived from the condensation of a fatty acid with an alcohol.

The fatty acids from which compound C is derived are chosen from the fatty acids already described in the case of compound A.

As regards the alcohols, these are chosen from:

- aliphatic alcohols having a single $C_{1\text{-}12}$ hydroxy functional group such as methanol ($C_1$), ethanol ($C_2$), isopropanol ($C_3$) and ethylhexanol ($C_8$); and
- $C_1$ to $C_{12}$ aliphatic alcohols having several hydroxy functional groups, and more particularly $C_5$ polyols such as pentaerythritol.

As representatives of fatty acid esters that can be used according to the invention, mention may especially be made of isopropyl oleate, methyl ricinoleate and ethylhexyl oleate and, as regards fatty acid polesters, pentaerythritol dioleate and pentaerythritol tetraoleate.

The choice of compounds A, B and C rests on their respective synergy in the A-B-C composition.

Thus, compound A is particularly advantageous for its low-pressure lubrication and easy cleanability properties, compound B is selected for its good high-pressure lubrication properties and finally compound C, apart from its satisfactory properties in terms of cleanability and high-pressure and low-pressure lubrication, contributes to improving the corrosion resistance of the A-B-C composition.

Advantageously, compounds A, B and C are chosen so that the iodine number of their mixture is less than 100.

The iodine number is the fixed mass of iodine in grams per 100 g of a fat. The higher the iodine number, the higher the number of unsaturated groups possessed by the fat or the mixture of fats.

In fact, the value of this iodine number is adjusted so as to obtained a compromise in terms of degree of unsaturation.

To minimize, and as far as possible avoid, the problems of oxidation of unsaturated fatty acids which result from the reaction of oxygen on the double bonds of the aliphatic chain so as to form allyl hydroperoxides that decompose into secondary products such as aldehydes, ketones and alcohol, it is desirable for the mixture of compounds A, B and C to possess the lowest possible number of unsaturated groups.

However, for too low an amount of unsaturation of the fatty acids, an A-B-C mixture is obtained which is insufficiently fluid at room temperature to be easily applicable to a metal surface. It is generally necessary either to heat it or dissolve it. This lack of fluidity is overcome for an iodine number greater than 20.

As a consequence, it has been necessary to adjust the iodine number to a value allowing the above two criteria to be satisfied, namely guaranteeing a number of unsaturated groups low enough to avoid fatty acid oxidation problems, while still remaining high enough for the A-B-C mixture to be liquid at room temperature. Thus, the iodine number of the A-B-C mixture is preferably between 20 and 100.

In addition, the inventors have found that by adding a fourth component D consisting of an amide to the A-B-C composition, the lubrication and corrosion resistance properties are further improved.

As representatives of compound D that can be used according to the invention, mention may be made of amides derived from the condensation of a fatty acid and an amine.

The fatty acids from which compound D is derived are chosen from the fatty acids already described in the case of compound A.

The amines are chosen from $C_2$–$C_6$ monoalkanolamines, dialkanolamines and trialkanolamines.

The subject of the present invention is also an oil composition for the temporary treatment of metal surfaces, characterized in that said composition contains:

at least 30% of at least one saturated or unsaturated $C_{\leqq 18}$ fatty acid triglyceride (compound A);

from 5 to 30% of at least one $C_{\leqq 18}$ fatty acid triglyceride with an oleic acid content of at least 60% by weight (compound B);

from 5 to 30% of at least one ester derived from the condensation of a $C_1$–$C_{12}$, preferably $C_1$–$C_2$, aliphatic alcohol with a $C_{\leqq 18}$ fatty acid (compound C); and from 5 to 20% of at least one amide derived from the condensation of a $C_{\leqq 18}$ fatty acid and a $C_2$–$C_6$ monoalkanolamine, dialkanolamine or trialkanolamine (compound D).

Whether in the use and/or in the composition according to the invention, each of compounds A, B, C and D is chosen so as to meet all the abovementioned criteria.

More preferably, the fatty acid of compound A is a saturated aliphatic acid (iodine number from 1 to 20) chosen from lauric, myristic, palmitic and stearic acids.

According to a preferred version of the invention, preference is given to its use in the form of coconut oil. Like all fats, coconut oil consists of a mixture of triesters between its fatty acids and the glycerol. The fatty acid composition of coconut oil is the following: 46% lauric ($C_{12:0}$) acid, 18% myristic ($C_{14:0}$) acid, 10% palmitic ($C_{16:0}$) acid and 7% oleic ($C_{18:1}$) acid.

Preferably, compound B is a genetically modified oleic-acid-enriched sunflower oil. This will be called hereafter, oleic sunflower oil. Its fatty acid composition is the following: 80% oleic ($C_{18:1}$) acid, 9% linoleic ($C_{18:2}$), acid, 5% stearic ($C_{18:0}$) acid and 3% palmitic ($C_{16:0}$) acid.

Advantageously, the compound C chosen is a fatty acid monoester.

According to a preferred embodiment of the invention, the fatty acid monoester is chosen from isopropyl oleate and methyl ricinoleate.

More preferably, the fatty acid monoester is methyl ricinoleate.

As regards compound D, the fatty acids used are preferably oleac acid and lauric acid.

According to a preferred embodiment of the invention, the amine is a dialkanolamine.

More preferably, the dialkanolamine used is diethanolamine.

According to a preferred version of the invention, the amide used is oleac diethanolamide (oleic acid DEA).

According to a preferred version of the invention, the composition comprises about 40% of compound A, about 20% of compound B and about 40% of compound C.

More preferably, the composition comprises about 40% of compound A, about 20% of compound B, about 30% of compound C and about 10% of compound D.

To obtain an oil composition which is, all at the same time, cleanable, lubricating at high and at low pressure, and corrosion resistant, the composition preferably comprises at least 30% of coconut oil (compound A), 5 to 30% of oleic sunflower oil (compound B), 5 to 30% of methyl ricinoleate (compound C) and 0 to 20% of oleic acid DEA (compound D).

In the case of the claimed composition, this generally comprises about 40% of compound A, about 20% of compound B, about 30% of compound C and about 10% of compound D. More preferably, this composition comprises at least 30% of coconut oil (compound A), 5 to 30% of oleic sunflower oil (compound B), 5 to 30% of methyl ricinoleate (compound C) and 10% of oleic acid DEA (compound D).

According to a preferred embodiment of the invention, at least one antioxidant is combined with the A-B-C or A-B-C-D oil compositions.

The compositions preferably include from 0 to 1% of at least one antioxidant. This antioxidant may be chosen from certain aromatic amines, such as diphenylamine derivatives, BHTs (strictly hindphenols), such as monomeric phenols or dimeric phenols, thioethers or phosphites.

According to another preferred embodiment of the invention, at least one corrosion inhibitor is combined with the A-B-C or A-B-C-D oil compositions.

The compositions preferably include between 0.5 and 5% of at least one corrosion inhibitor. This corrosion inhibitor may be chosen from sulfonates such as calcium dialkylbenzenesulfonates, dinonalnaphthalenesulfonates, didodecylbenzenesulfonates and ester sulfonates, succinic acid derivatives such as succinic acid half-esters, imidazoline, half-imides or N-acylsarcosine derivatives, fatty acid amides and imides, sodium benzoates and sebacates, long-chain aliphatic amines and compounds based on amines and fatty acids or fatty acid acetates.

The A-B-C or A-B-C-D oil compositions are applied to the metal surfaces as a thin layer by spraying, using an electrostatic oil sprayer, with a grammage of 0.5 to 3 g/m$^2$, preferably 1 g/m$^2$.

Although the metal surfaces coated with one of the conventional mineral oils for temporary corrosion protection have an oily appearance, the metal surfaces coated with a film of the A-B-C or A-B-C-D compositions with a grammage of around 1 g/m$^2$ advantageously have a dry appearance. This dry appearance is particularly beneficial in terms of cleanliness in workshops in which the metal surfaces thus treated are being handled and/or formed.

Within the context of the invention, the term "metal parts" is understood to mean hot-rolled and pickled steel sheet or plate, cold-rolled then pickled steel sheet or plate, and coated steel sheet such as electrogalvanized steel sheet or hot-dip galvanized steel sheet.

As regards the application of the oil compositions according to the invention to the metal part to be treated, this may be carried out by any suitable conventional means, by a spraying, dipping, coating or spin-on technique. The oil compositions are applied both to a metal part at room temperature and to a hot (40 to 80° C.) metal part. The part thus treated may then be dried by heating, raising the part to a temperature between 20 and 150° C.

The third subject of the present invention is a metal part treated according to the invention, at least one surface of which part is coated with a film of an oil composition according to the invention.

Equipment and Methods

1/Compound A.

The compound A chosen was coconut oil, composed of triglycerides of fatty acids having relatively short saturated chains:

| |
|---|
| 46% lauric ($C_{12:0}$) acid; |
| 18% myristic ($C_{14:0}$) acid; |
| 10% palmitic ($C_{16:0}$) acid; |
| 7% oleic ($C_{18:1}$) acid. |

2/Compound B.

The compounds B used were oleic sunflower oil or Edenol (rapeseed methyl ester). The fatty acid composition of the oleic sunflower oil was the following:

| |
|---|
| 83% oleic ($C_{18:1}$) acid; |
| 9% linoleic ($C_{18:3}$) acid; |
| 5% stearic ($C_{18:0}$) acid; |
| 3% palmitic ($C_{16:0}$) acid. |

The fatty acid composition of the rapeseed oil from which the Edenol was derived was the following:

| |
|---|
| 90% ricinoleic ($C_{18:1,OH}$) acid; |
| 3% linoleic ($C_{18.3}$) acid; |
| 3% oleic ($C_{18:1}$) acid. |

3/Compound C.

Compound C was methyl ricinoleate.

4/Compound D.

Compound D was oleic acid diethanolamide (oleic acid DEA).

5/Corrosion Inhibitors.

6/Antioxydants.

The oil compositions were stable and liquid at room temperature. Unless otherwise indicated, the claimed compositions were applied at 1 g/m$^2$ by spraying onto the sheet heated to 40° C. and then dried for 24 h at room temperature. The metal used was a pickled hot-rolled steel.

Methods

1/Frictional characterization of the compositions tested.

The one-pass friction tests were carried out under a pressure varying from 200 to 2000 daN with tools made of high-speed steel having an area of one cm$^2$.

Test pieces were taken from pickled hot BS2 sheet 1.7 mm in thickness.

The tribology tests were carried out in the following manner:

The test apparatus was a flat-on-flat tribometer of a type known per se.

The test pieces to be tested were clamped with a clamping force $F_s$ between two plates made of high-speed steel having an area of 1 cm$^2$ for bearing on (or sliding over) the test pieces.

The friction coefficient N was measured while moving the test piece with respect to the plates over a total distance D of 180 mm at a speed of 10 mm/$F_s$ while progressively increasing the clamping force $F_s$.

2/Corrosion Characterization.

The various compositions tested were applied to test pieces of a pickled hot-rolled S235 steel 2 mm in thickness.

The following tests were carried out in environmental chambers:

hot-wet cycle (FKW-DIN 50017 cycle);

transport cycle tight packets.

2.1—Hot-wet Corrosion.

The test pieces to be tested were placed in an environmental chamber corresponding to the DIN 50017 standard, simulating the conditions of corrosion of the outer turn of a coil of sheet or corrosion of an individually cut sheet during storage.

The details of the hot-wet cycle (one cycle=24 hours) are given below:

8 h at 40° C. and 95–100% RH (relative humidity);

16 h at 20° C. and 75% RH.

The test pieces were individually suspended vertically.

The result of the test was obtained by recording the number of successive cycles before traces of corrosion appeared on the test piece.

2.2 Transport Corrosion.

The test pieces to be tested were placed in an environmental chamber as tight packets of 4 test pieces, which simulates the corrosion conditions at the core of a coil of sheet or of a packet of individual sheets during a transport step.

The details of the cycle (one cycle=32 hours) are given below:

10 h at 40° C. and 95% RH;

4 h at 20° C. and 85% RH;

10 h at −5° C. and 0% RH;

8 h at 30° C. and 85% RH.

After 6 cycles for a first specimen of packets and 12 cycles for a second specimen, the packets were opened and the state of corrosion of the interfaces of the test pieces was observed.

This state of corrosion was classified according to the following ratings:

0: no pits;

0.25: 1 pit;

0.5: 2 pits;

0.75: 3 pits;

1: >3 pits;

2: slight pitting;

3: moderate pitting;

4: intense pitting;

5—generalized pitting.

3/Cleanability Characterization

The cleanability (as % wetted area) of a treated specimen was evaluated in the following manner:

The treated specimen was subjected to the action of an alkaline cleaning bath under predefined conditions.

The ability of the treated specimen to be cleaned was evaluated by the degree of wetting of the specimen after cleaning.

The cleaning bath used had the following composition:

demineralized water;

sodium metasilicate (35 g/l);

trisodium phosphate (16 g/l);

10-mol-ethoxylated nonylphenol (4 g/l);

nitrolacetic acid (2 g/l).

The specimen was completely immersed in this bath at 60° C. for 3 minutes, then preferably rinsed in a bath of untreated water for one minute and then under a jet of water for 30 seconds.

After rinsing, the specimen was drained by holding it inclined at 45° C. and the percentage of area that remained wetted after draining for 30 seconds was measured.

The surfaces on which there was no break in the film of water were regarded as being 100% cleaned; otherwise the percentage of dewetting was noted by subtracting it from 100%.

This cleanability test was carried out on a freshly coated test piece and on a test piece artificially aged in an oven at 160° C. for 15 minutes.

EXAMPLE 1

In this example, the performance of a formulation according to the present invention was tested. This was formulation I which used coconut oil as component A.

The formulation according to the present invention used this coconut oil with oleic sunflower as component B and methyl ricinoleate as component C. Its detailed composition was as follows:

| |
|---|
| 40% coconut oil.<br>40% methyl ricinoleate;<br>20% oleic sunflower. |

The performance of this composition according to the present invention was tested in terms of hot-wet cycle, transport test, cleanability and tribology, The corresponding results are given in table I below.

This table also includes the performance of control formulations whose compositions are also indicated in this table.

These various formulations—control formulations and formulation according to the invention, are compared with a conventional mineral oil, QUAKER 8021 oil.

TABLE I

| Composition | Hot-wet cycle | Transport, rating at x cycles 6 | 12 | Cleanability Fresh | Aged | Tribology: friction coefficient measured at 1800 daN |
|---|---|---|---|---|---|---|
| Formulation I | >30 | 3 | 5 | 100% | 100% | 0.08 |
| Control formulations: | | | | | | |
| T1<br>50% coconut<br>50% Edenol | 8 | 1.5 | 3.5 | 100% | 100% | 0.10 |
| T2<br>30% Edenol<br>10% oleic acid DEA<br>60% methyl ricinoleate | >30 | 0 | 0.25 | 100% | 80% | 0.15 (scratches) |
| T3 | >30 | 0.25 | 0.5 | 95% | 85% | 0.15 |

TABLE I-continued

| Composition | Hot-wet cycle | Transport, rating at x cycles 6 | 12 | Cleanability Fresh | Aged | Tribology: friction coefficient measured at 1800 daN |
|---|---|---|---|---|---|---|
| 40% Edenol<br>20% oleic acid DEA<br>40% methyl ricinoleate | | | | | | |
| T4<br>60% methyl ricinoleate<br>10% oleic acid DEA<br>30% oleic sunflower | >30 | 1 | 2 | 100% | 30 | 0.14 |
| Quaker 8021 | >30 | 1 | 2 | 100% | 100% | 0.15 (seizing) |

From these results it is apparent that only the formulation according to the present invention allows all of the criteria tested, apart from corrosion resistance during the transport test, to be satisfactorily met.

EXAMPLE 2

In this example, the performance of an A-B-C composition to which compound D was added was tested.

Formulation II of the A-B-C-D composition according to the invention was the following:

| |
|---|
| 40% coconut oil;<br>20% sunflower oil;<br>30% methyl ricinoleate;<br>10% oleic acid DEA |

As in the previous example, the performance of this composition was tested in terms of the hot-wet cycle, transport test, cleanability and tribology.

TABLE II

| Composition | Hot-wet cycle | Transport, rating at x cycles 6 | 12 | Cleanability Fresh | Aged | Tribology: friction coefficient measured at 1800 daN |
|---|---|---|---|---|---|---|
| Formulation II | >30 | 1 | | 100% | 95% | 0.06 |
| Quaker 8021 | 30 | 1 | 2 | 100% | 100% | 0.15 (seizing) |

Analysis of the results clearly show that the presence of an oleic acid DEA in an amount of 10% in formulation II markedly improves the resistance of the steel coated with this formulation II to the transport test. The rating indicating the degree of pitting of the steel coated with formulation I was 3, while it is now only 1 with the steel coated with formulation II.

Furthermore, the tribological aspect is also improved since the friction coefficient goes from 0.08 with the steel coated with formulation I to 0.06 with the steel coated with formulation II.

What is claimed is:

1. A method of treating a metal surface, comprising the step of applying to the metal surface an oil composition for temporarily protecting and lubricating the metal surface, said method being further characterized by the step of choosing said composition to contain:

at least 30% of at least one saturated or unsaturated $C_{\leqq 18}$ fatty acid triglyceride (compound A);

from 5 to 30% of at least one $C_{\leqq 18}$ fatty acid triglyceride with an oleic acid content of at least 60% by weight (compound B);

from 5 to 30% of at last one ester derived from the condensation of a $C_1$–$C_{12}$, preferably $C_1$–$C_2$, aliphatic alcohol with a $C_{\leqq 18}$ fatty acid (compound C); and optionally, from 5 to 20% of at least one amide derived from the condensation of a $C_{\leqq 18}$ fatty acid and a $C_2$–$C_6$ monoalkanolamine, dialkanolamine or trialkanolamine (compound D).

2. The method as claimed in claim 1, characterized in that the mixture of compounds A, B and C possesses an iodine number of less than 100.

3. The method as claimed in claim 1, characterized in that the fatty acid triglyceride is either a natural vegetable oil or a synthetic oil obtained by the reaction of one mole of glycerol with three moles of fatty acid or of a mixture of fatty acids.

4. The method as claimed in claim 1, characterized in that compound A is an unsaturated fatty acid triglyceride preferably chosen from oleic acid, linoleic acid and ricinoleic acid triglycerides.

5. The method as claimed in claim 1, characterized in that compound A is a saturated fatty acid triglyceride, preferably chosen from lauric acid, myristic acid, palmitic acid and stearic acid triglycerides.

6. The method as claimed in claim 1, characterized in that compound A is a saturated natural vegetable oil, such as coconut oil.

7. The method as claimed in claim 1, characterized in that compound B is a natural vegetable oil contained 60% to 90% oleic acid.

8. The method as claimed in claim 1, characterized in that compound B is a genetically modified vegetable oil.

9. The method as claimed in claim 8, characterized in that the genetically modified vegetable oil derives from safflower oil, rapeseed oil, sunflower oil, soybean oil or palm oil, by themselves or as one of their mixtures.

10. The method as claimed in claim 1, characterized in that the fatty acid from which compound C is derived is a fatty acid chosen from oleic, linoleic, linolenic, ricinoleic, lauric, myristic, palmitic and stearic acids, by themselves or as mixture thereof.

11. The method as claimed in claim 10, characterized in that it involves ricinoleic acid.

12. The method as claimed in claim 1, characterized in that the alcohol from which compound C is derived chosen from methanol, ethanol, isopropanol, ethylhexanol and pentaerythritol.

13. The method as claimed in claim 1, characterized in that said composition comprises, as compound C, isopropyl oleate or preferably methyl ricinoleate.

14. The method as claimed in claim 1, characterized in that the fatty acid from which compound D is derived is a fatty acid as defined in claim 10.

15. The method as claimed in claim 1, characterized in that the amine from which compound D is derived is preferably diethanolamine.

16. The method as claimed in claim 1, characterized in that compound D is an oleic acid diethanolamide.

17. The method as claimed in claim 1, characterized in that the composition comprising about 40% of compound A, about 20% of compound B and about 40% of compound C is employed.

18. The method as claimed in claim 1, characterized in that the composition comprises about 40% of compound A, about 20% of compound B, about 30% of compound C and about 10% of compound D.

19. The method as claimed in claim 1, characterized in that an oil film is deposited on at least one metal surface with a grammage of 1 $g/m^2$.

20. The method as claimed in claim 1, characterized in that said metal surface is a coated or uncoated, pickled, hot-rolled or cold-rolled steel sheet or steel plate.

21. An oil composition for the temporary treatment of metal surfaces, characterized in that said composition contains:

at least 30% of at least one saturated or unsaturated $C_{\leqq 18}$ fatty acid triglyceride (compound A);

from 5 to 30% of at least one $C_{\leqq 18}$ fatty acid triglyceride with an oleic acid content of at least 60% by weight (compound B);

from 5 to 30% of at least one ester derived from the condensation of a $C_1$–$C_{12}$, preferably $C_1$–$C_2$, aliphatic alcohol with a $C_{\leqq 18}$ fatty acid (compound C); and from 5 to 20% of at least one amide derived from the condensation of a $C_{\leqq 18}$ fatty acid and a $C_2$–$C_6$ monoalkanolamine, dialkanolamine or trialkanolamine (compound D).

22. The composition as claimed in claim 21, characterized in that said composition comprises about 40% of compound A, about 20% of compound B, about 30% of compound C and about 10% of compound D.

23. The composition as claimed in claim 21, characterized in that it comprises at least 30% of coconut oil (compound A), 5 to 30% of oleic sunflower oil (compound B), 5 to 30% of methyl ricinoleate (compound C) and 10% of oleic acid DEA (compound D).

24. A metal part obtained by the method of claim 1, characterized in that at least one of surfaces of the part is coated with a film of said oil composition.

* * * * *